US005979050A

United States Patent [19]

Counterman et al.

[11] Patent Number: 5,979,050

[45] Date of Patent: Nov. 9, 1999

[54] AIR PREHEATER HEAT TRANSFER ELEMENTS AND METHOD OF MANUFACTURE

[75] Inventors: Wayne S. Counterman, Wellsville; Gary Foster Brown, Andover; Tadek Casimir Brzytwa, Wellsville; Michael Mimg-Ming Chen, Wellsville; Scott Frederick Harting, Wellsville; James David Seebald, Wellsville, all of N.Y.

[73] Assignee: ABB Air Preheater, Inc., Wellsville, N.Y.

[21] Appl. No.: 08/874,291

[22] Filed: Jun. 13, 1997

[51] Int. Cl.[6] ..... B23P 15/26

[52] U.S. Cl. ..... 29/890.034; 165/10; 165/8; 29/890.039; 72/197

[58] Field of Search ..... 29/890.034, 890.039; 72/187, 196, 197; 165/6, 8, 10

[56] References Cited

U.S. PATENT DOCUMENTS

| | | | |
|---|---|---|---|
| 2,329,789 | 9/1943 | Schank et al. | 72/187 |
| 2,940,736 | 6/1960 | Ödman | 257/245 |
| 4,553,458 | 11/1985 | Schoonover | 83/33 |
| 4,744,410 | 5/1988 | Groves | 165/10 |
| 5,491,997 | 2/1996 | Ogawa | 72/177 |

FOREIGN PATENT DOCUMENTS

| | | |
|---|---|---|
| 0 522 360 A2 | 6/1992 | European Pat. Off. . |
| 702137 | 1/1954 | United Kingdom . |
| 899773 | 6/1962 | United Kingdom . |
| WO 96/41691 | 12/1996 | WIPO . |

OTHER PUBLICATIONS

International Search Report for International Patent No. PCT/US 98/07023 completed Jul. 24, 1998.

*Primary Examiner*—S. Thomas Hughes
*Assistant Examiner*—Jermie E. Cozart
*Attorney, Agent, or Firm*—Alix, Yale & Ristas, LLP

[57] ABSTRACT

Heat transfer elements for rotary regenerative heat exchangers are formed with spacing ridges or notches having flow-disrupting indentations in the peaks of the notches formed at selected intervals to project into the flow channels. These projections interrupt the boundary layer and cause turbulence and mixing to enhance the heat transfer. Various methods of forming the indentations are disclosed.

3 Claims, 10 Drawing Sheets

AIR PREHEATER HEAT TRANSFER ELEMENTS AND METHOD OF MANUFACTURE

BACKGROUND OF THE INVENTION

The present invention relates to rotary regenerative air preheaters for the transfer of heat from a flue gas stream to an incoming combustion air stream and particularly to the configuration of the heat transfer elements for the air preheater and the method of manufacturing those elements.

A rotary regenerative heat exchanger is employed to transfer heat from one hot gas stream, such as a hot flue gas stream, to another cold gas stream, such as combustion air. The rotor contains a mass of heat absorbent material which first rotates through a passageway for the hot gas stream where heat is absorbed by the heat absorbent material. As the rotor continues to turn, the heated absorbent material enters the passageway for the cold gas stream where the heat is transferred from the absorbent material to the cold gas stream.

In a typical rotary heat exchanger, such as a rotary regenerative air preheater, the cylindrical rotor is disposed on a horizontal or vertical central rotor post and divided into a plurality of sector-shaped compartments by a plurality of radial partitions, referred to as diaphragms, extending from the rotor post to the outer peripheral shell of the rotor. These sector-shaped compartments are loaded with modular heat exchange baskets which contain the mass of heat absorbent material commonly formed of stacked plate-like heat transfer elements.

Conventional heat transfer elements for regenerative air preheaters are form-pressed or roll-pressed steel sheets or plates which are then stacked to form the mass of heat transfer material. One typical arrangement is for the plates to be formed with spaced apart ridges, usually double ridges projecting from opposite sides of the plate, which extend along the plate either in the direction of flow or obliquely thereto and which serve to space the plates from each other. The spacing forms the flow channels between the plates for the flow of flue gas and air. For examples of such heat transfer elements, reference is made to U.S. Pat. Nos. 4,744,410 and 4,553,458.

One of the effects of using these ridges to provide the spacing of the heat transfer elements is that they form flow paths through the bundle of heat transfer elements which are larger in cross-sectional area per surface area of exposed plate surface than the cross-sectional area per surface area of the other portions of the plate. This results in lower flow resistance, less turbulence and mixing, greater mass flow of gas and air and lower heat transfer as compared to the remainder of the plates. Therefore, although the ridges do provide structural integrity and accurate spacings, they have their negative effect on heat transfer.

SUMMARY OF THE INVENTION

The present invention relates to the method of forming heat transfer elements and to the heat transfer elements formed by the method whereby the heat transfer performance of the heat transfer elements is improved. Specifically, the invention relates to heat transfer elements which have spaced ridges or notches formed across the plates wherein flow-disrupting indentations are formed at selected intervals in the peaks of the notches which project into the portions of the flow channels formed by the notches. The flow-disrupting projections change the size of the flow channel (height, width, and/or cross sectional area), interrupt the boundary layer, cause turbulence and mixing and result in enhanced heat transfer.

DESCRIPTION OF THE PREFERRED EMBODIMENT

Figure 1:
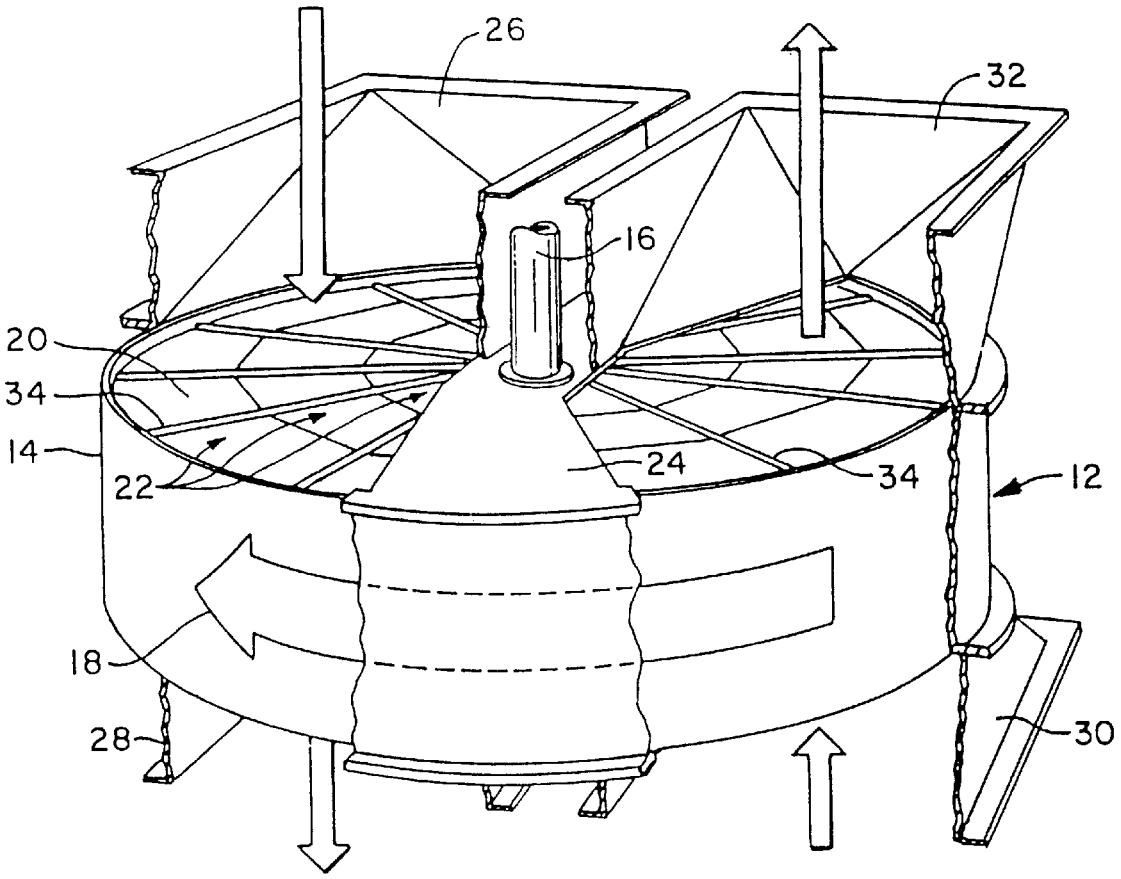
FIG. 1 is a general perspective view of a conventional rotary regenerative air preheater.

FIG. 1 of the drawings is a partially cut-away perspective view of a typical air heater showing a housing 12 in which the rotor 14 is mounted on drive shaft or post 16 for rotation as indicated by the arrow 18. The rotor is composed of a plurality of sectors 20 with each sector containing a number of basket modules 22 and with each sector being defined by the diaphragms 33. The basket modules contain the heat exchange surface. The housing is divided by means of the flow impervious sector plate 24 into a flue gas side and an air side. A corresponding sector plate is also located on the bottom of the unit. The hot flue gases enter the air heater through the gas inlet duct 26, flow through the rotor where heat is transferred to the rotor and then exit through gas outlet duct 28. The countercurrent flowing air enters through air inlet duct 30, flows through the rotor where it picks up heat and then exits through air outlet duct 32.

Figure 2:
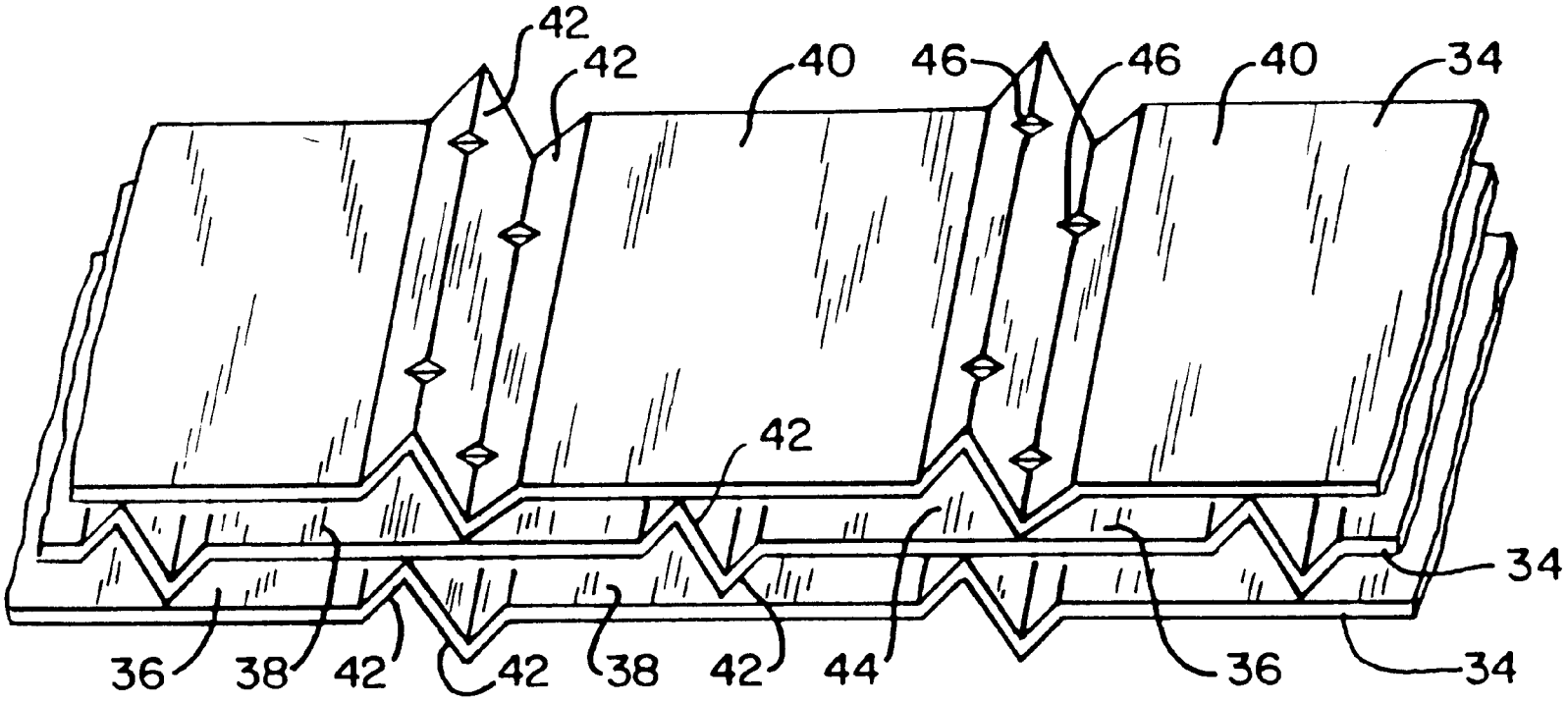
FIG. 2 is a perspective view of a portion of a heat transfer element assembly incorporating the present invention.

FIG. 2 depicts portions of three of the stacked heat exchange plates 34 which are contained in the basket modules 22 and which are formed in accordance with the present invention. Of course, there would be a large number of such plates 34 in each module. The plates 34 are stacked in spaced relationship thereby providing passageways 36 and 38 therebetween for the flow of flue gas and air.

Figure 3:
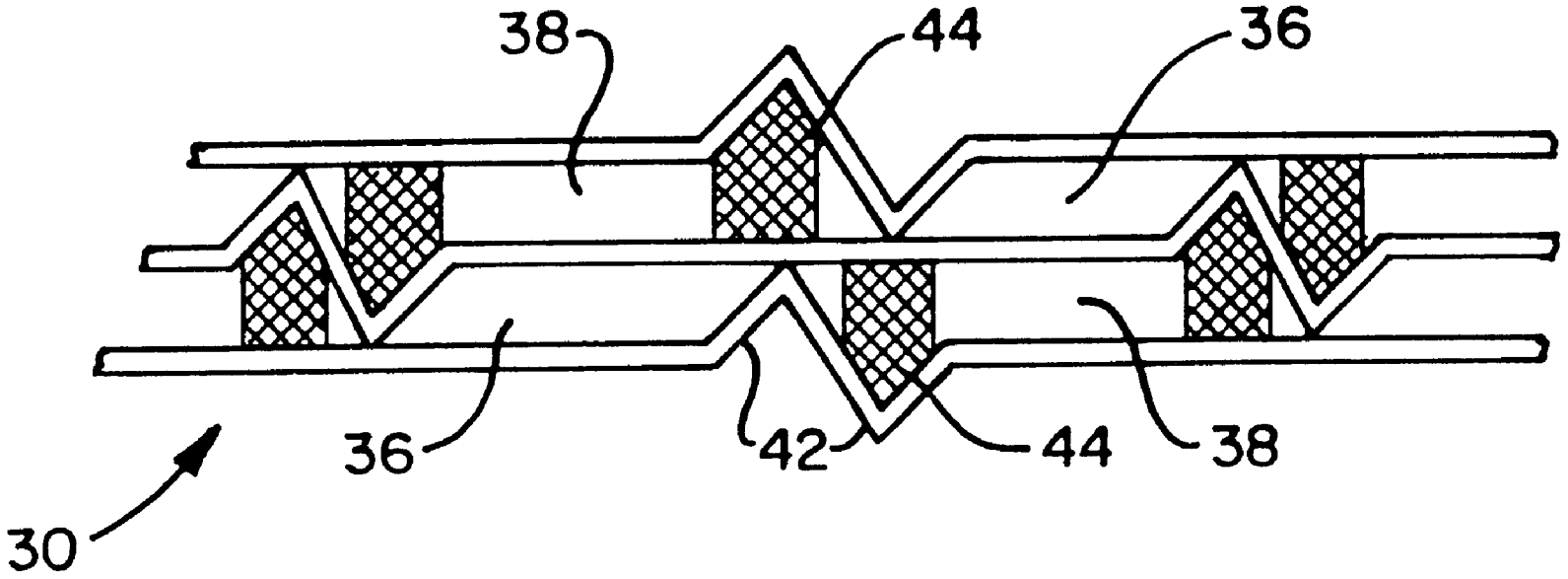
FIG. 3 is a side view of a portion of a heat transfer element assembly illustrating the flow channels.

The plates 34 are usually formed of thin sheet metal and are capable of being rolled or stamped to the desired configuration. The plates are formed with flat sections 40 and opposed notches 42 which provide the means for spacing the adjacent plates a predetermined distance apart to form the previously mentioned flow channels or passageways 36 and 38. As can be seen more clearly in FIG. 3 which shows a side view of a portion of three stacked plates, the available area of the flow path 44 for the flow of fluid between the notches 42 and the adjacent plate, which is shown as being cross-hatched, is significantly greater per surface area of exposed heat transfer surface than the remaining (uncross-hatched) area for the flow of fluid between the flat sections 40 of adjacent plates. This flow path 44 has lower flow resistance and less turbulence and mixing. A greater percentage of the flow per heat transfer surface area of exposed element passes through these flow paths or channels 44 than through the remainder of the flow passageways 38 and also through the flow passages 36. All of these factors result in a lower heat transfer in this area of the flow path 44.

The present invention provides means in the flow channels 44 to disrupt the flow thereby minimally increasing flow resistance, creating turbulence and mixing and disrupting the boundary layer. The flow disrupting means thereby improves the specific heat transfer performance in the channels 44 and the overall heat transfer performance of the stacked plates. It also serves to push some of the flow out of the notch channel and intermixes it with the flow in the other areas, for example, flow passages 36 and 38 in FIGS. 2 and 3. This intermixing reduces temperature differences between the fluid in passage 44 and passages 36 and 38, which would otherwise exist.

Figure 4:
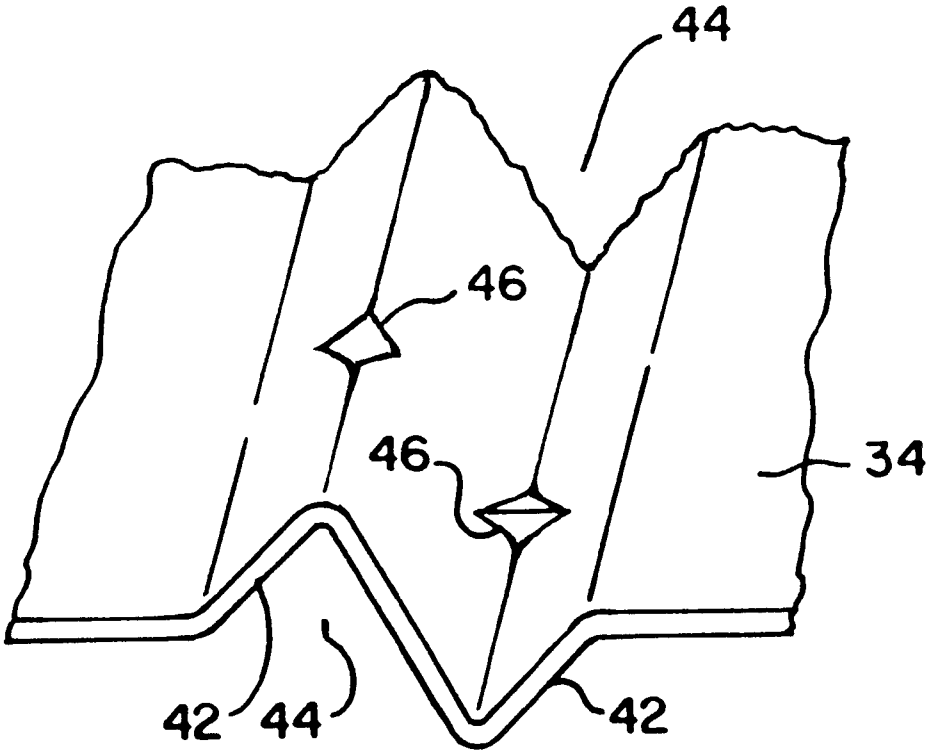
FIG. 4 is an enlarged perspective view of a portion of one heat transfer plate illustrating the present invention.

FIG. 2 shows the flow disrupting means which comprise deformations or indentations 46 which are formed into the peaks of the notches 42 to extend into the channels 44 at spaced intervals. These indentations are also shown in FIG. 4 which is an enlarged view of a portion of one plate 34 showing these indentations more clearly. As can be seen most clearly in FIG. 4, the dent 46 in the upwardly extending, left hand notch 42 comprises a small depression in the peak of the notch such that the underside of the indentation 46 extends down into flow area 44 under the plate. Likewise, the downwardly extending, right hand notch 42 has an indentation 46 which is similarly formed and which extends up into the right hand flow area 44 on top of the plate.

These flow disrupting means or indentations 46, because they extend into the fluid flow path through the channels 44 disrupt the boundary layer and create turbulence and mixing thereby improving the heat transfer. In fact, the improvement in heat transfer can be significant even when the dents 46 are quite small and without the need to have them closely spaced. For example with a notch height of 0.38 inches (the distance from the top of one notch extending from one side of the plate to the top of the paired notch extending from the other side of the plate), indentations spaced at 2.5 inch intervals with an average depth of only 0.100 inches show an increase of 9.5% in heat transfer for an equal volume or quantity of heat transfer plates. Or, because the plates can now be spaced further apart due to the increased heat transfer, a comparable heat transfer can be obtained with 8% less plate material in the modules than for plates without the present invention.

Figure 5:
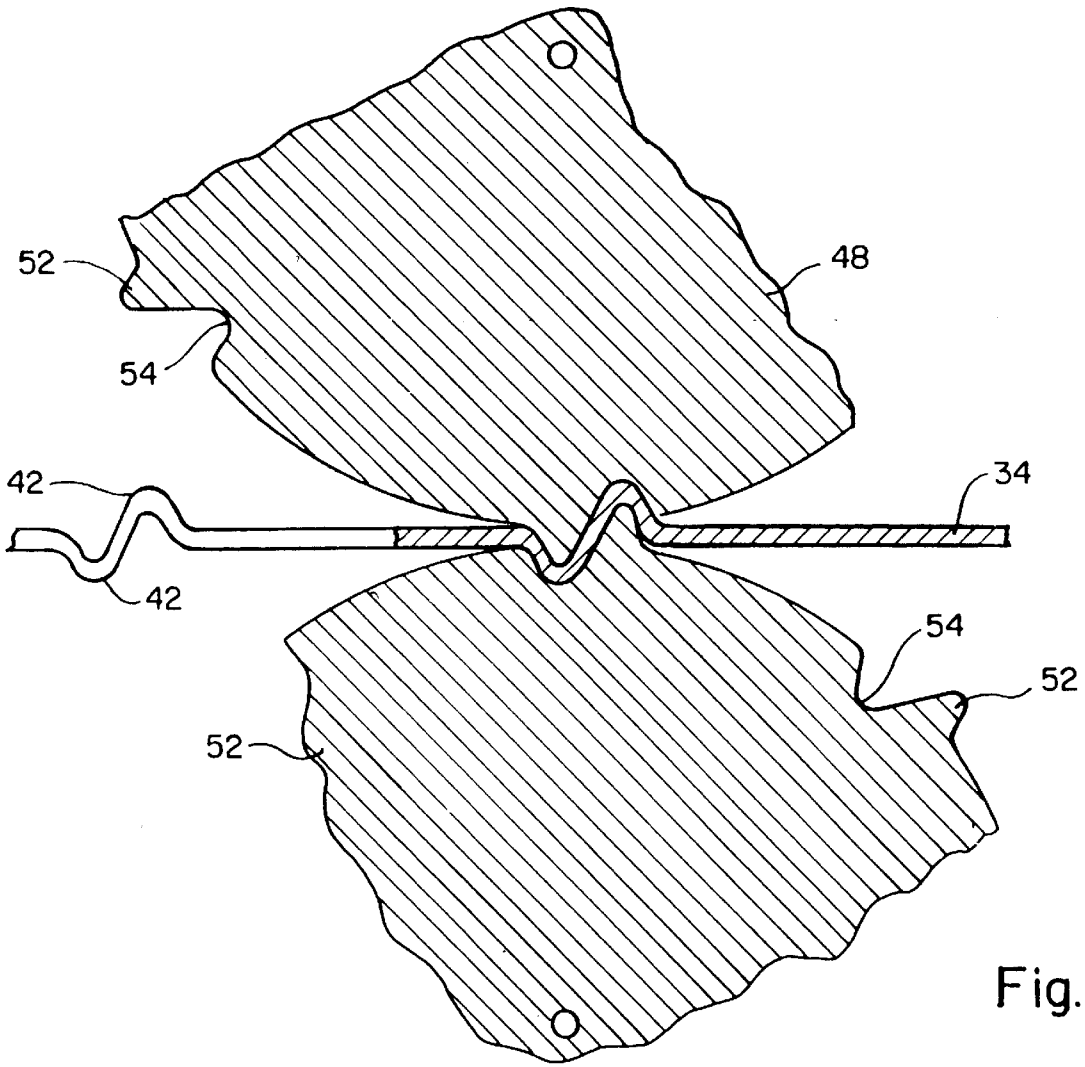
FIG. 5 is a section view of a portion of a plate forming method illustrating the formation of plates with the notches.
Figure 6:
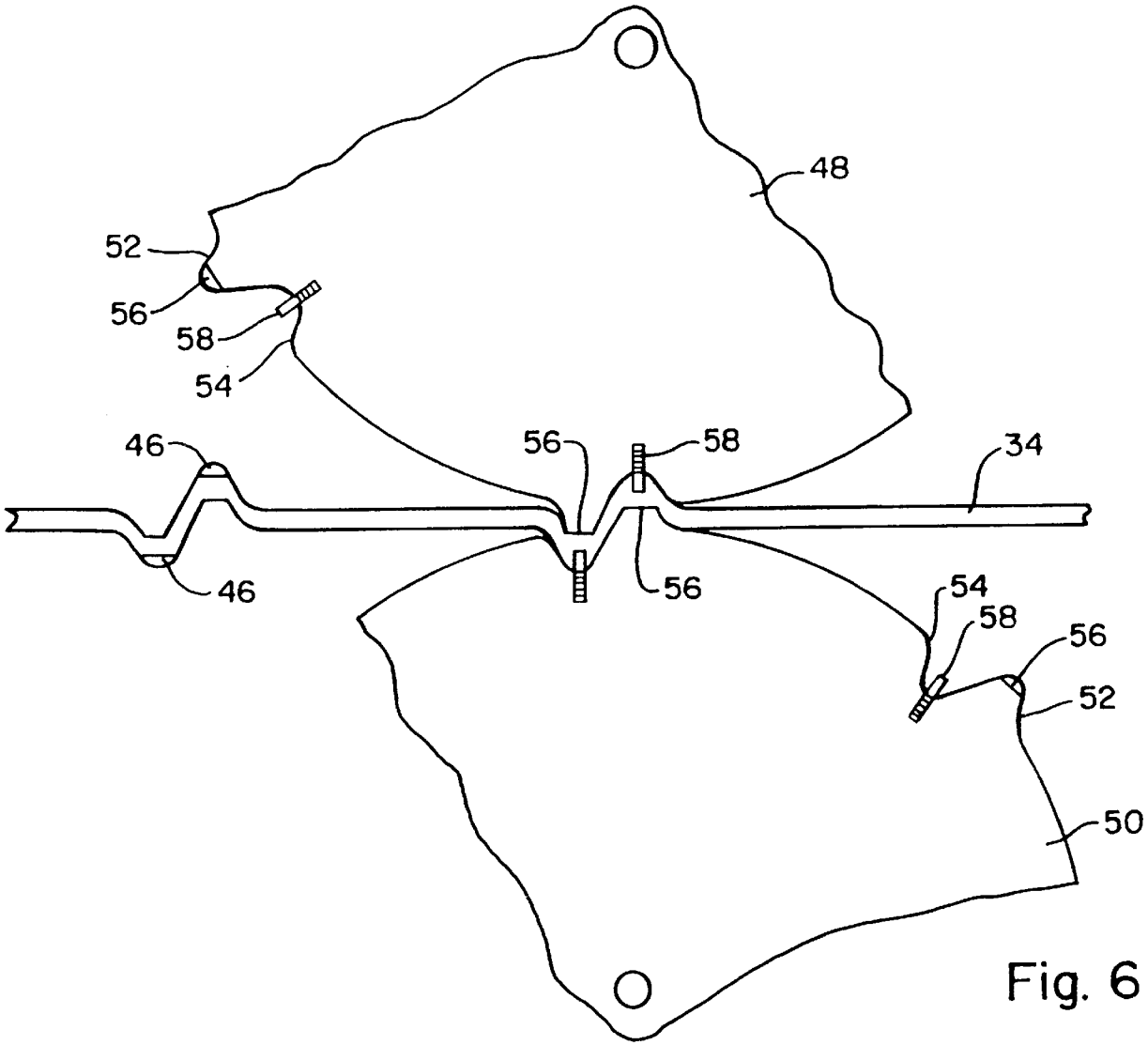
FIG. 6 is a view of another section of the rolls of FIG. 5 showing the means for forming the flow disrupting indentations.
Figure 7:
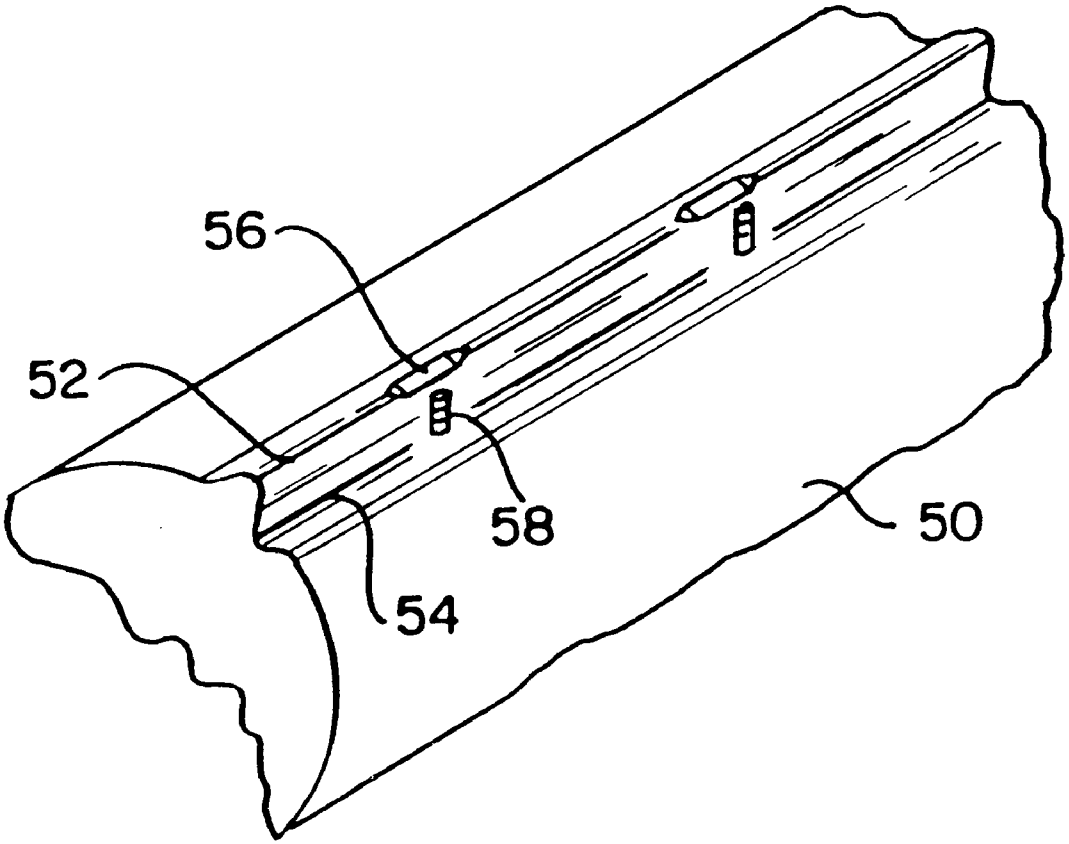
FIG. 7 is a perspective view of a portion of one of the rolls of FIGS. 5 and 6.

FIGS. 5, 6 and 7 illustrate the equipment used in one method of forming the heat transfer plates of the present invention. In this method, the opposed forming rolls 48 and 50 which are used to form the notches 42 in the plate 34 are modified to form the indentations 46. FIG. 5 is a cross section through the rolls and through the plate at a location where there are no indentations. The projections 52 on the forming rolls cooperate with the depressions 54 to form the notches 42.

FIG. 6, which is a figure similar to FIG. 5, is a cross-section through the rolls and through the plate at a location where the means for forming the indentation are located. FIG. 7 is a perspective view of a portion of one roll which also illustrates these indentation forming means. As shown, the projections 52 on the forming rolls are cut away at 56 in the shape and to the extent required to form the indentations 46. The depressions 54 are fitted with denting pins 58 which project upwardly from the bottom of the depressions 54 and which cooperate with the mating cut away portions 56 on the matching roll to form the indentations.

Figure 8:
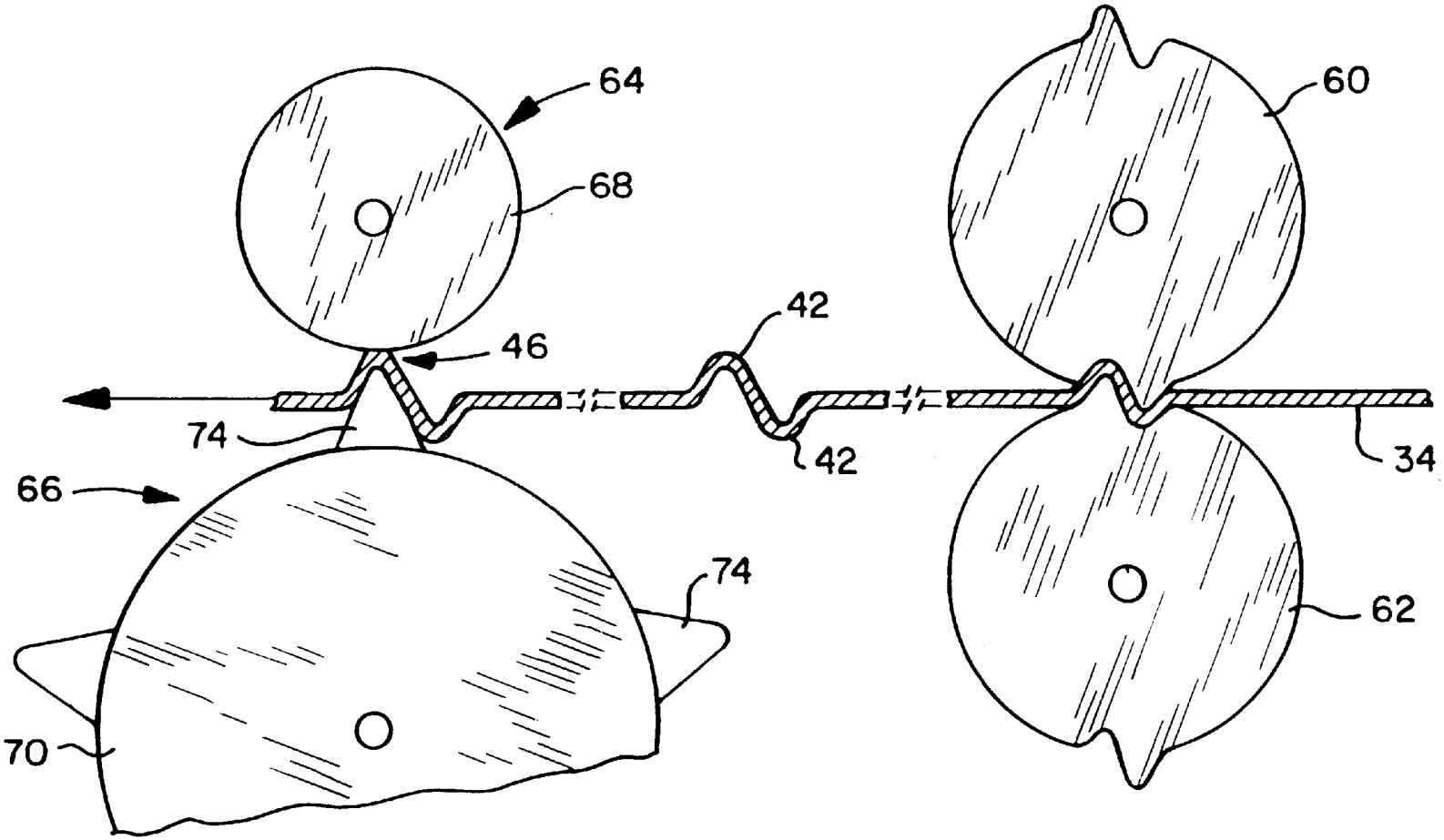
FIG. 8 is a section view of a portion of an alternate plate forming method of the present invention.
Figure 9:
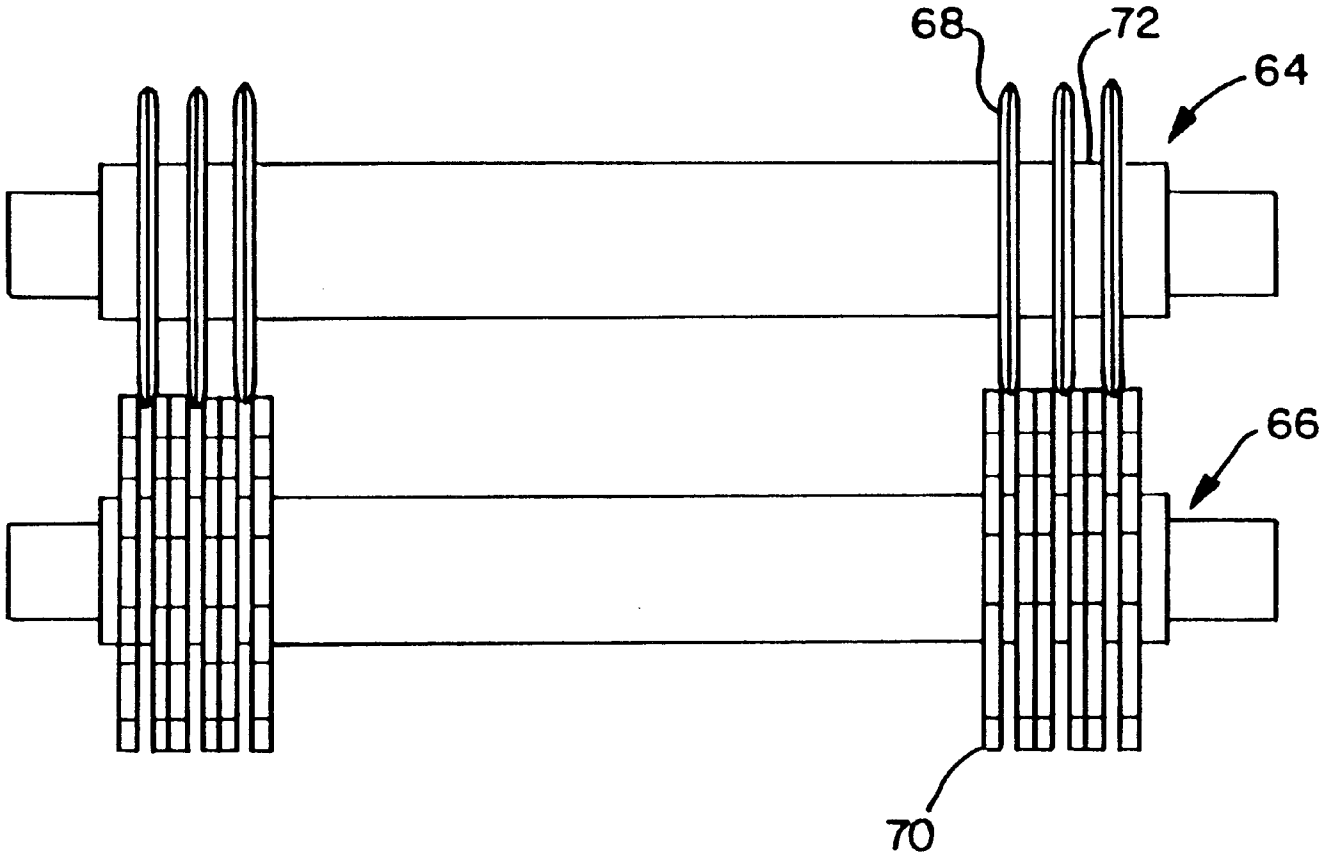
FIG. 9 is a front view of the indentation forming rollers of FIG. 8.

FIGS. 8 and 9 illustrate another method of forming the indentations 46 in the heat transfer plates of the present invention. In FIG. 8, the forming rolls 60 and 62 are similar to the forming rolls 48 and 50 of FIG. 5 but they are only for the purpose of forming the notches 42. They are not modified to form the indentations 46. In the FIGS. 8 and 9 method, the plate 34 with the formed notches 42 is passed through the indentation forming rollers 64 and 66. The roller 64 comprises a series of disks 68 which are spaced apart a distance equal to the desired spacing between indentations as shown in FIG. 9. The roller 64 preferably has spacers 72 between the disks 68 such that the spacers 72 of varying widths can be used to vary the distance between dents. The circumferential edges of the disks 68 are shaped and aligned such that they will engage the notches 42 and form indentations of the desired shape and depth.

The roller 66 is for the purpose of supporting the notches on the sides of the indentations as they are being formed. This provides control of the depth of the indentations and prevents unwanted deformation of the sheet except in the specific area of the indentations. The roller 66 comprises a series of disks 70 which contain the notch supports 74. These notch supports are shaped such that they extend into the notches and conform to the shape of the notches. They are aligned on the roller 66 so that there is a support disk 70 on each side of each disk 68 as shown in FIG. 9. In FIG. 8, the illustrated support disk 70 is behind the indentation 46 which is being formed. In this particular method, the indentations are formed only on the notches on one side of the plate 34 at a time. The plate in FIG. 8 would then progress to the next station where the indentations on the bottom notch would be formed in the same manner. This embodiment shown in FIGS. 8 and 9 is the presently preferred method for forming the indentations in a step separate from the step of forming the notches. Another, less preferred method is to replace the roller 66 with a roller identical to roller 64. The plate then passes between the resulting pair of rollers 64 which forms reasonable indentations. However, this tends to reduce the notch height over a larger area rather than just locally.

Figure 10:
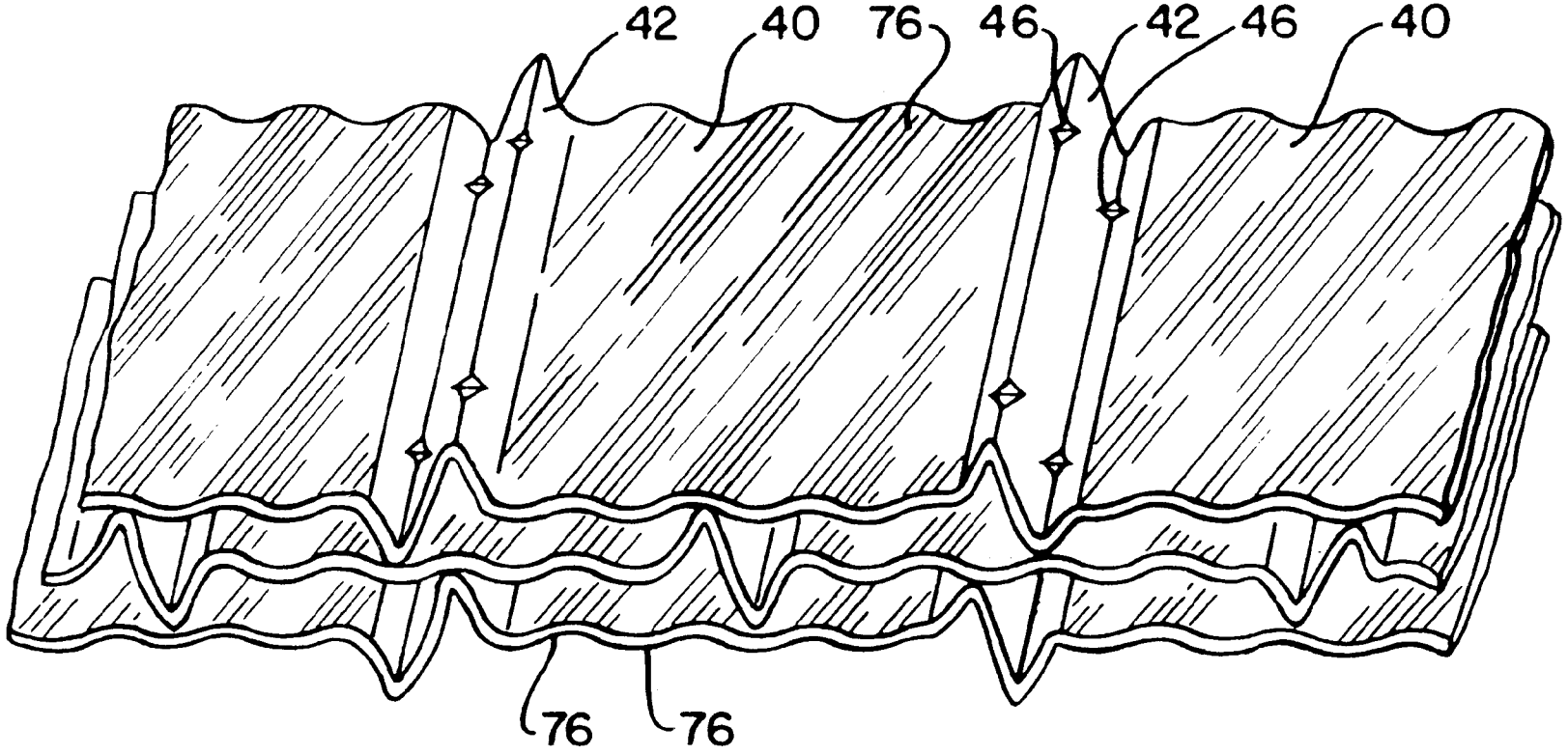
FIG. 10 is a perspective view of a portion of a heat transfer element assembly of the present invention applied to undulating plates.

Although certain heat transfer plate configurations have been used for illustration, the invention also applies to other configurations of notched plates. For example, the notches may be oriented parallel to the fluid flow or they may be at an angle up to 45°. The invention also applies to plates with notches extending out on only one side as opposed to the illustrated double-sided notch arrangement. Further, the so-called flat sections of the plates between notches may in fact be an undulated surface as is common in the art. This embodiment is illustrated in FIG. 10 where the sections 40 between the notches 42 have undulations or corrugations 76 which are relatively shallow compared to the height of the notches and which are typically inclined at an acute angle to the direction of the notches and the direction of fluid flow.

The use of plates having an undulating surface leads to a still further method of forming the indentations. When the plate to be notched is already undulated or otherwise contains a significantly textured surface, the notching rolls can be formed so that they work in conjunction with the undulations to simultaneously form the notches and indentations. The notching roll has a discontinuous notch pattern across the width of the roll. In areas where the notch pattern is present, the undulation is flattened and the notch is roll-formed. Where there are gaps in the notch pattern on the roll, the existing undulation shape remains to a significant extent thereby producing the desired effect of an indentation or bump into the notch channel. This may be done with the same equipment shown in FIGS. 5, 6 and 7 but without the necessity of having the denting pins 58.

Merely by way of example, a plate with a notch height of 0.965 cm (0.380 inches) may have indentations spaced at 6.35 cm (2.5 inches) and to an average depth of 0.254 cm (0.100 inches). The total width of an indentation may be on the order of 0.635 cm (0.25 inches). While specific details of the assembly of heat transfer elements and several variations of the method of forming the elements have been described, the invention is intended to include equivalents and be limited only by the claims.

We claim:

1. A method of forming heat transfer plates for a heat exchanger comprising the steps of:

a. passing a sheet of heat transfer plate material through a pair of forming rolls having notch forming projections and recesses therein whereby spaced notches are formed in said material extending thereacross and projecting outwardly from said material to a peak; and b. passing said material with said spaced notches therein through a pair of indentation forming rollers, one of said pair of indentation forming rollers forming indentations in said peaks of said notches at selected intervals and the other of said pair of indentation forming rollers supporting said notches adjacent said indentations.

2. A method of forming heat transfer plates for a heat exchanger comprising the steps of:

a. providing a sheet of heat transfer plate material having undulations extending obliquely thereacross;

b. providing a cooperating pair of forming rolls having notch forming projections and recesses extending across said rolls parallel to the axes of said rolls, said notch forming projections having spaced apart gaps;

c. passing said sheet of material having said undulations through said cooperating pair of forming rolls whereby spaced notches are formed in said material extending thereacross at an angle to said undulations and projecting outwardly from said material to a peak higher than said undulations and whereby said gaps in said notch forming projections and said undulations cooperate to form spaced apart indentations in said peaks of said notches.

3. A method of forming heat transfer plates for a heat exchanger comprising the steps of:

a. providing a cooperating pair of forming rolls having notch forming projections and recesses extending across said rolls, said notch forming projections having spaced cut away portions and said recesses having spaced indentation forming projections located to correspond and cooperate with said cut away portions;

b. passing a sheet of heat exchange plate material through said cooperating pair of rolls whereby spaced notches are formed in said material extending thereacross and projecting outwardly to a peak and whereby said cut away portions and said indentation forming projections cooperate to form indentations in said peaks of said notches.

* * * * *